US005273275A

United States Patent [19]

Wilkerson

[11] Patent Number: 5,273,275

[45] Date of Patent: Dec. 28, 1993

[54] PORTABLE BASKETBALL FREETHROW RETURN DEVICE

[76] Inventor: Larry J. Wilkerson, 1222 24th St., Des Moines, Iowa 50311

[21] Appl. No.: 896,158

[22] Filed: Aug. 20, 1992

[51] Int. Cl.[5] ..... A63B 69/00

[52] U.S. Cl. ..... 273/1.5 A

[58] Field of Search ..... 273/1.5 A, 396, 397

[56] References Cited

U.S. PATENT DOCUMENTS

| | | | |
|---|---|---|---|
| 1,765,269 | 7/1930 | Hatley | 273/1.5 A |
| 3,233,896 | 2/1966 | King | 273/1.5 |
| 3,776,550 | 12/1973 | McNabb | 273/1.5 A |
| 3,814,421 | 6/1974 | Spier, Jr. | 273/1.5 A |
| 3,901,506 | 8/1975 | Caveney | 273/1.5 A |
| 3,917,263 | 11/1975 | Wiley | 273/1.5 A |
| 4,579,339 | 4/1986 | Grimm | 273/1.5 A |
| 4,579,340 | 4/1986 | Jenkins et al. | 273/1.5 A |
| 4,667,957 | 5/1987 | Joseph | 273/1.5 A |
| 4,697,810 | 10/1987 | Mathison | 273/1.5 A |
| 4,714,248 | 12/1987 | Koss | 273/1.5 A |
| 4,786,371 | 11/1988 | Postol | 273/1.5 A |
| 4,838,549 | 6/1989 | Woodall | 273/1.5 A |
| 4,869,502 | 9/1989 | Wares | 273/1.5 A |
| 4,913,431 | 4/1990 | Jakobs | 273/1.5 A |
| 4,915,380 | 4/1990 | Ackerman | 273/1.5 A |
| 5,016,875 | 5/1991 | Joseph | 273/1.5 A |
| 5,060,940 | 10/1991 | Mullen | 273/1.5 A |
| 5,165,680 | 11/1992 | Cass | 273/1.5 A |
| 5,171,009 | 12/1992 | Filewich et al. | 273/1.5 A |

*Primary Examiner*—Paul E. Shapiro

[57] ABSTRACT

An improved, portable basketball return device which includes a ball collector formed by telescopingly interconnected upper and lower ball deflectors, with the lower deflectors pivotly connected on opposed sides of an inclined ball return panel. An extensible and retractable chute depending from the front of the collector for directing basketballs from the collector, by gravity, towards the player standing near the freethrow line. The collector is mounted atop a vertically extensible and collapsable lift apparatus, permitting the collector and chute to be adaptable to basketball goals fixed permanently at the regulation playing height, or alternately, goals that have been adjusted and temporarily fixed at some other height along the basketball standard, wall or pole. The retractable, foldable and collapsable features of this device make for a compact and convenient storage position.

15 Claims, 4 Drawing Sheets

70L
86L
30
72L
82
76L
64L
72R
82
74L
86R
32
76R
84
70R
64R
36
60L
2
42
74R
62L
34
50
84
58R
56L
60R
56R
38
46L
68
98L
62R
98R
46R
94L
92L
48
68
96L
100L
94R
228
68
92R
2
102
44
104
96R
100R
134
90
228
134
164L
40
126
158L
168R
156L
158R
156R
166L
182
162R
154L
136
116
180
176
160R
140
126
230
152
120
166R
138
154R
180
170R

PORTABLE BASKETBALL FREETHROW RETURN DEVICE

BACKGROUND

1. Field of Invention

This invention relates to basketball training devices, specifically to a basketball freethrow return device for use by a player practicing free throw shooting to improve shooting accuracy, concentration and technique.

2. Description of Prior Art

Over time, basketball players practicing the art of free throw shooting, have demonstrated that concentration and shooting technique are the basic qualities for accurate free throw shooting. The unproductive time and energy required to rebound the basketball after each successful of unsuccessful shot is therefore detrimental to becoming skilled at free throw shooting.

Thus, basketball players have demonstrated the need for a basketball retrieval device that will significantly reduce or eliminate the amount of unproductive time and energy spent rebounding the basketball after each practice shot.

Furthermore, the invention and widespread use of adjustable height basketball goals and backboards for young, short statured players, has created another problem. Ball retrieval devices must now have the adaptability to accommodate goals fixed temporarily at abnormal heights along the basketball standard. This situation necessitates ball retrieval devices to incorporate a flexibilty for height adjustment, while effectively returning the ball to the player standing at the free-throw line.

Heretofore, several inventors have created a variety of ball retrieval or return devices aimed at resolving the rebounding inconveniences associated with practice free throw or field goal shooting. The majority of these devices are functional dependent upon the basketball goal being fixed at a predetermined distance, or regulation height above the playing surface. Adjustable height goals are now common in use and are capable of being temporarily fixed at distances varying 1 to 4 feet lower than the normal regulation height. Consequently, prior art examples disclose devices with limited adaptability for accommodating free throw shooting on goals that have been lowered.

U.S. Pat. Nos. 5,016,875 to Joseph, 4,913,431 to Jakobs, 4,838,549 to Woodall; 4,667,957 to Joseph; 4,697,810 to Mathison and 3,776,550 to McNabb, are relevant to my present invention. These devices are capable of collecting and returning basketballs whether or not the ball passes through the goal. These devices are also generally restricted to use with goals fixed at the regulation playing height. U.S. Pat. No. 5,016,875 to Joseph, discloses a vertically extensible and collapsable frame, but the frame is primarily for wedging purposes and ease of disassembly. Also, the elongated, extensible ball return ramp impairs its use with goals fixed at an abnormal height. Similar structural limitations prevent the remaining prior art references from functioning properly with lowered goals. These inventions also share similar disadvantages characterized by spacious, awkward ball collectors. Accordingly, with the exception of Joseph (5,016,875), these devices have limited portability, require large storage areas and are generally restricted to indoor use. Furthermore, valuable practice time is wasted on assembly and disassembly of the ball collectors. Consequently, the embodiments of these ball retrieval devices prohibit set-up and use by a significant segment of players, specifically; young, short statured players.

U.S. Pat. No. 3,901,506 to Caveney discloses a ball retrieval device capable of capturing and returning successful or unsuccessful shots with ball deflectors pivotly attached to a frame and mountable on the upper portion of the backboard. Use of this device with a lowered goal would require modifications to the discharge net, which depends downward from the frame towards the free-throw line. Although being simple in design, lightweight and portable, it may be difficult for some players to secure this device to the backboard.

Several related ball return devices have been invented, specifically: U.S. Pat. Nos. 4,869,502 to Wares, 4,786,371 to Postol, 4,714,248 to Koss; 4,579,339 to Grimm; 3,917,263 to Wiley; 3,814,421 to Spier, Jr., 3,233,896 to King and 1,765,269 to Hatley. These devices are categorized by retrieving and returning only basketballs having passed through the goal. Therefore, unproductive and disruptive time is spent rebounding missed shots. Also, the ball returning effectiveness of these devices would be seriously hampered by use with other than a standard height goal. U.S. Pat. No. 4,579,340 to Jenkins, et al., is another device that returns only successful shots and by structure, is functional primarily with goals fixed at the normal playing height.

In this discussion of prior art, it is evident that prior to the present invention, none of the ball retrieval devices mentioned herein specifically relates to or references the adaptability to adjustable height basketball goals. The need still remains for a simple, truly portable basketball return device that is acceptable and useful to a majority of basketball players, regardless of age or stature.

OBJECTS AND ADVANTAGES

Accordingly, several objects and advantages of the present invention are:

(a) to provide an improved basketball freethrow return device that is superior to those cited as prior art;

(b) to provide a basketball freethrow return device having a ball collection means capable of retrieving most basketballs whether or not the ball passes through the goal;

(c) to provide a basketball freethrow return device having an extensible and retractable chute to channel the basketball from the collection means and return the ball towards the player standing at or near the free-throw line;

(d) to provide a basketball freethrow return device having a selectively adjustable, vertically extensible and collapsable lifting means for raising and lowering the collection means and chute to receive the basket;

(e) to provide a basketball freethrow return device adaptable to basketball goals fixed at the normal regulation playing height and goals fixed at a distance considerably lower than the regulation playing height;

(f) to provide a basketball freethrow return device that functions independent of the goal, backboard, standard or wall;

(g) to provide a basketball freethrow return device that is suitable for indoor and outdoor use;

(h) to provide a basketball freethrow return device that is simple and lightweight for ease of use;

(i) to provide a basketball freethrow return device with retractable, foldable and collapsable features for convenient storage;

(j) to provide a basketball freethrow return device generally suitable for use by basketball players of almost any age or stature desiring to improve free throw shooting accuracy.

Further objects and advantages of the present invention will become apparent from a consideration of the ensuing description and drawings.

DRAWING FIGURES

Figure 1:
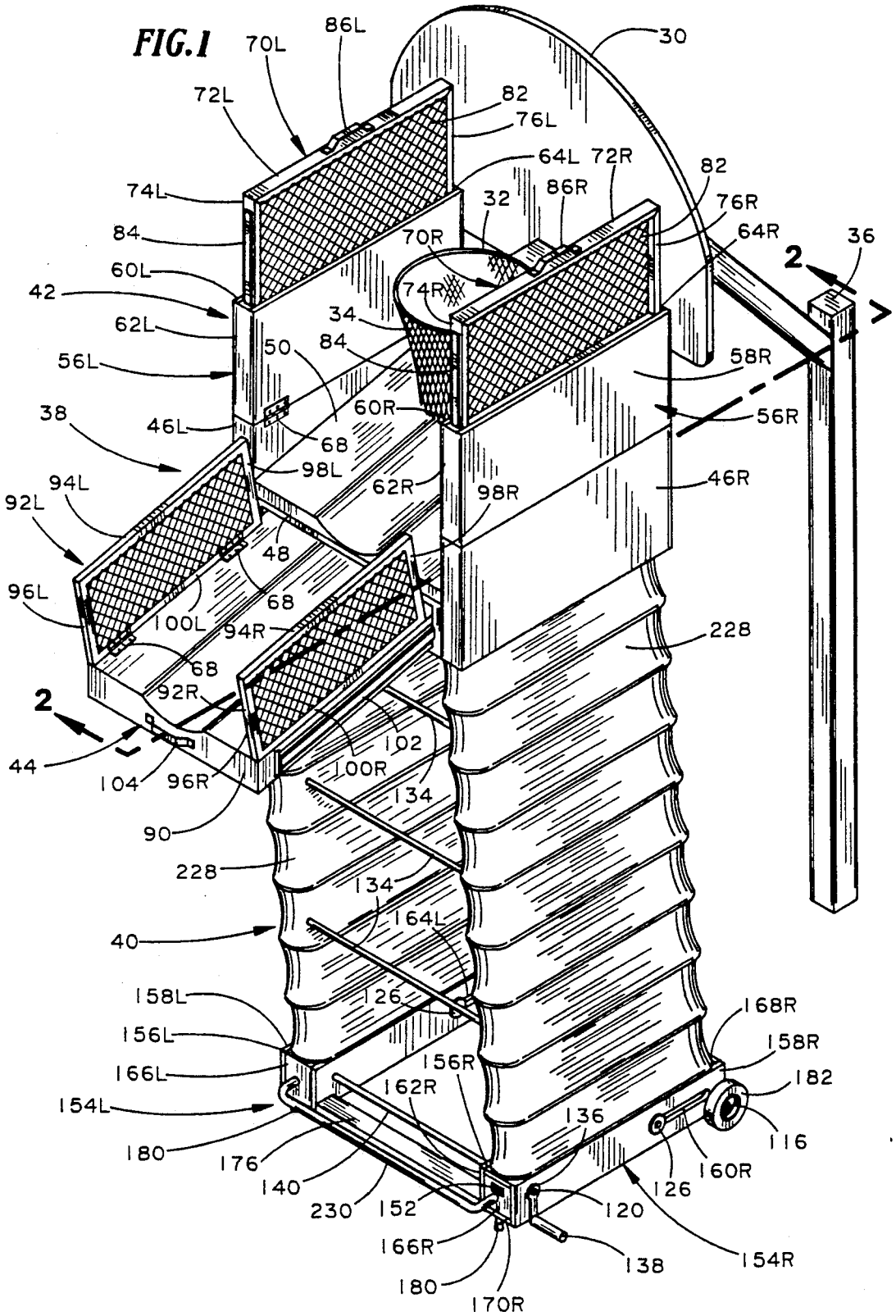
FIG. 1 shows a perspective view of the basketball freethrow return device in its operative association with a basketball goal, backboard and standard.

| Reference Numerals In Drawings | |
|---|---|
| 30 | backboard |
| 32 | rim |
| 34 | netting |
| 36 | standard |
| 38 | basketball freethrow return device |
| 40 | scissor lift |
| 42 | ball collector |
| 44 | chute |
| 46R | right support |
| 46L | left support |
| 48 | face panel |
| 50 | grooved ball return panel |
| 52 | rear panel |
| 54 | cavity |
| 56R | right lower deflector |
| 58R | side wall |
| 60R | side wall |
| 62R | front wall |
| 64R | rear wall |
| 66R | bottom wall |
| 56L | left lower deflector |
| 58L | side wall |
| 60L | side wall |
| 62L | front wall |
| 64L | rear wall |
| 66L | bottom wall (not shown) |
| 68 | hinge |
| 70R | right upper deflector |
| 72R | top frame portion |
| 74R | side frame portion |
| 76R | side frame portion |
| 78R | bottom frame portion |
| 80R | cavity (not shown) |
| 70L | left upper deflector |
| 72L | top frame portion |
| 74L | side frame portion |
| 76L | side frame portion |
| 78L | bottom frame portion |
| 80L | cavity |
| 82 | netting |
| 84 | deflector drawer slide |
| 86R | deflector handle |
| 86L | deflector handle |
| 88 | bottom enclosure panel |
| 90 | grooved bottom panel |
| 92R | right retainer |

-continued

| Reference Numerals In Drawings | |
|---|---|
| 94R | top frame portion |
| 96R | side frame portion |
| 98R | side frame portion |
| 100R | bottom frame portion |
| 92L | left retainer |
| 94L | top frame portion |
| 96L | side frame portion |
| 98L | side frame portion |
| 100L | bottom frame portion |
| 102 | chute drawer slide |
| 104 | chute handle |
| 106 | screw |
| 108 | hole |
| 110R | right mounting plate |
| 112R | slot |
| 110L | left mounting plate |
| 112L | slot |
| 114 | bracket |
| 116 | bolt |
| 118 | nut |
| 120 | cap nut |
| 122 | spacer |
| 124 | bushing |
| 126 | roller |
| 128 | pulley |
| 130R | right cable |
| 130L | left cable |
| 132 | eye connector |
| 134 | stabilizer bar |
| 136 | crank arm |
| 138 | crank handle |
| 140 | crank shaft |
| 142 | crank shaft gear |
| 144R | right take-up reel |
| 144L | left take-up reel |
| 146 | worm gear transmission |
| 148 | output gear |
| 150 | electric motor |
| 152 | motor control |
| 154R | right floor support |
| 156R | top panel |
| 158R | side panel |
| 160R | slot |
| 162R | side panel |
| 164R | slot |
| 166R | front panel |
| 168R | rear panel |
| 170R | bottom panel |
| 172R | opening |
| 174R | cavity |
| 154L | left floor support |
| 156L | top panel |
| 158L | side panel |
| 160L | slot |
| 162L | side panel |
| 164L | slot |
| 166L | front panel |
| 168L | rear panel |
| 170L | bottom panel |
| 172L | opening |
| 174L | cavity |
| 176 | brace |
| 178 | shock absorbing material |
| 180 | leg |
| 182 | wheel |
| 184 | right scissor arm assembly |
| 186 | scissor arm |
| 188 | scissor arm |
| 190 | scissor arm |
| 192 | scissor arm |
| 194 | scissor arm |
| 196 | scissor arm |
| 198 | scissor arm |
| 200 | scissor arm |
| 202 | left scissor arm assembly |
| 204 | scissor arm |
| 206 | scissor arm |
| 208 | scissor arm |
| 210 | scissor arm |
| 212 | scissor arm |
| 214 | scissor arm |

-continued

| Reference Numerals In Drawings | |
|---|---|
| 216 | scissor arm |
| 218 | scissor arm |
| 220 | pivot connection |
| 222 | pivot connection |
| 224 | pivot connection |
| 226 | pivot connection |
| 228 | scissor assembly cover |
| 230 | handle |

DESCRIPTION OF THE PREFERRED EMBODIMENT

Referring to the drawings, FIG. 1 shows a basketball freethrow return device 38 in operative association with backboard 30, rim 32 and standard 36. The basketball freethrow return device 38, includes a ball collector 42 and chute 44 mounted atop a selectively adjustable, vertically extensible and collapsable scissor lift 40. Ball collector 42 comprises identical support panels 46R, 46L, face panel 48, identical lower ball deflectors 56R, 56L, similar upper ball deflectors 70R, 70L, a grooved basketball return panel 50 and rear panel 52. Preferably, return panel 50, is a one-piece panel with a molded center groove being semi-circular and slightly wider than the diameter of a standard basketball. Face panel 48 has a substantially lenghtwise opening which is hidden from view by chute 44.

Figure 2:
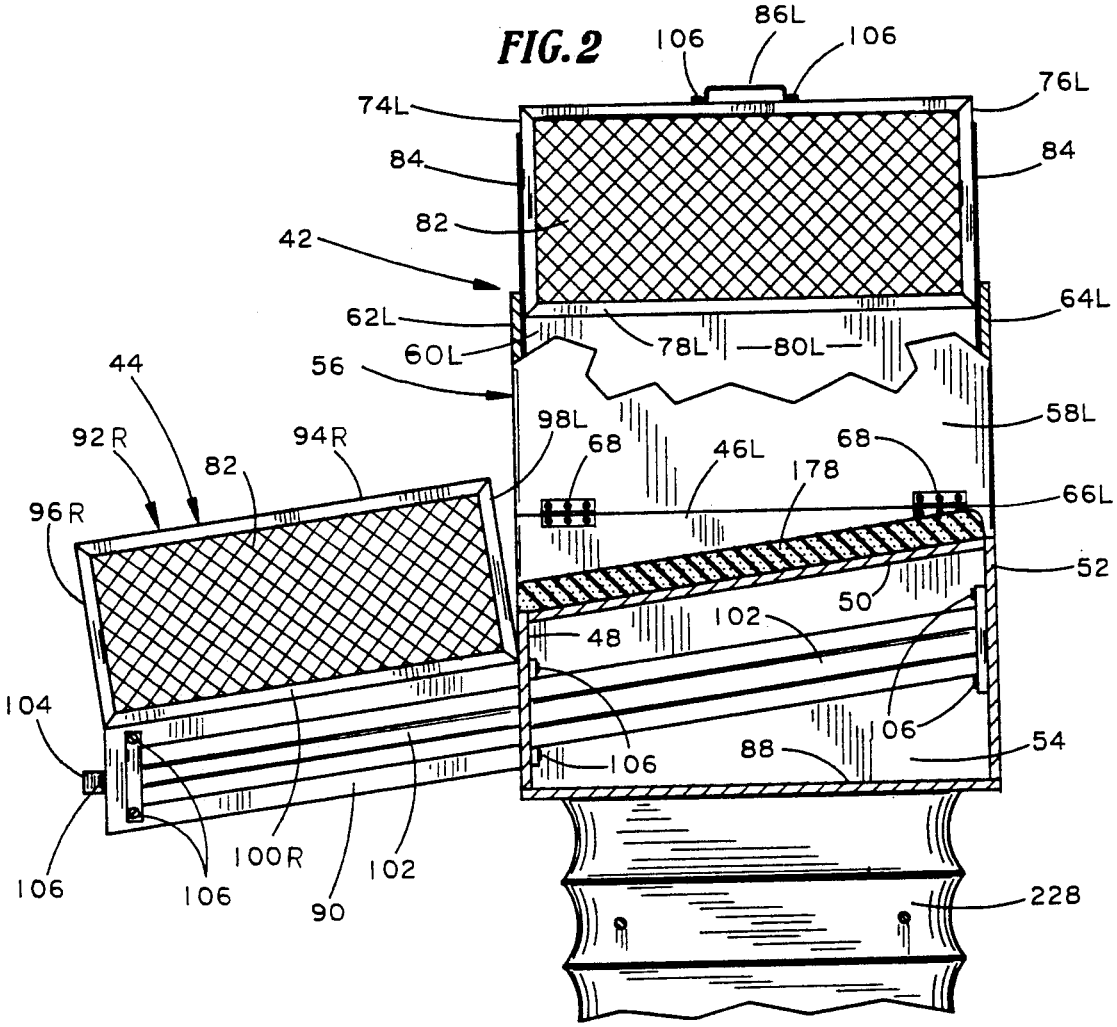
FIG. 2 is partial sectional side view of the device taken along line 2—2 of FIG. 1.
Figure 7:
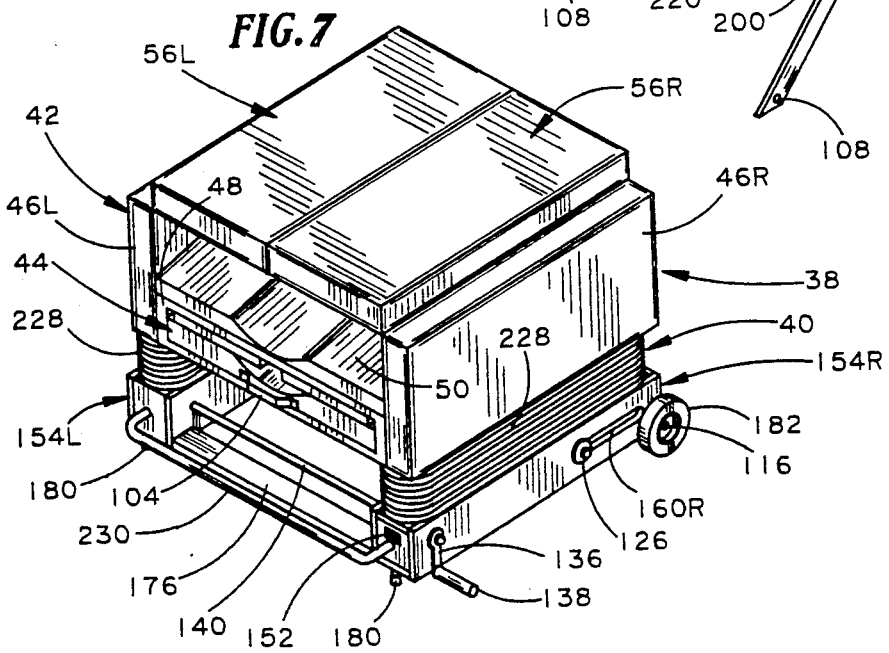
FIG. 7 is a perspective view of the device first disclosed in FIG. 1, in its completely folded, retracted and collapsed storage position.

As best shown in FIG. 2, the front end of return panel 50 is attached along the top edge of face panel 48, while the rear end of return panel 50 is attached along the top edge of rear panel 52. The height of rear panel 52 is significantly greater than that of face panel 48, resulting in a forward sloping ramp-like structure. A shock absorbing material 178 is fixed to the flat surfaces of return panel 50 to create a "dead ball" or limit bouncing of the basketball when striking return panel 50. A bottom enclosure panel 88 is attached along the bottom edges of face panel 48 and rear panel 52. The resulting substantially rectangular cavity 54, is formed when support panels 46R and 46L are attached substantially upright on opposed sides of return panel 50. Supports 46R and 46L are shown in FIGS. 1 and 7.

As further shown in FIG. 1, collector 42 includes a pair of lower deflectors 56R and 56L. Right deflector 56R comprises identical side walls 58R, 60R, front wall 62R, rear wall 64R and bottom wall 66R. Walls 58R–66R, when connected, form a substantially rectangular enclosure having an open top and closed bottom creating cavity 80R. Deflector 56R is hinged atop support 46R using a plurality of hinges 68. Preferably, the hinges are of the self-closin or ratchet type, whose folding members can remain releasably locked in a rigidly open or closed position. The left lower deflector 56L is identical to deflector 56R and similarly assembled using walls 58L–66L, creating cavity 80L. Deflector 56L is hinged atop support 46L using hinges 68. Hinges 68 will permit deflectors 56R and 56L to fold from a rigidly upright operable position, to a flat position above return panel 50. Cavity 80R is best shown in FIG. 2, while cavity 80L is not shown in any drawing figures. Bottom wall 66R can be seen in FIGS. 1 and 7, while wall 66L is hidden from view.

Prior to the completed assembly of deflectors 56R, 56L, as described above, a pair of drawer slides 84 are installed within each cavity 80R and 80L. Drawer slide 84 is commonly known, wherein one or more movable members telescopingly slides along a track or tracks provided by a second stationary member. Drawer slide 84 is hereinafter understood as a descriptive reference to include both stationary and slidable members. Preferably, the drawer slides used in this embodiment of the present invention, have a self-actuating latching system for releasably locking in either a fully extended or completely retracted position.(latching system not shown) As shown in FIG. 2, the stationary member of slide 84 is fixed vertically to the inward facing portion of wall 62R. A second slide 84 is fixed similarly to wall 64R. The sliding members of slides 84 will remain unattached for now, but will be referred to again later.

Referring to FIG. 1 again, collector 42 further includes a pair of identical upper deflectors 70R and 70L. Right upper deflector 70R comprises top frame portion 72R, identical side frame portions 74R, 76R and bottom frame portion 78R. Frame portions 72R–78R, when connected, form a substantially rectangular frame-like structure with netting 82 laced, stitched or otherwise attached to each frame portion. Deflector 70L is a mirror image of deflector 70R, and comprises frame portions 72L–78L with netting 82. Alternately, deflectors 70R, 70L can be formed by one-piece, solid panels without netting 82.

As described earlier, and shown in FIG. 2, the unattached sliding members of slides 84 are now fixed to portions 74R and 76R respectively of deflector 70R. A second pair of slides 84 are installed in cavity 80L using walls 62L, 64L of deflector 56L and portions 74L, 76L of deflector 70L, respectively. The result being deflectors 70R, 70L are now glidingly linked or slidingly attached within cavities 80R, 80L. Deflectors 70R, 70L can now be telescopingly raised and releasably locked into their uppermost ball deflection position using handles 86R and 86L. Deflectors 70R, 70L can also be lowered into their inoperable storage positions within cavities 80R, 80L of deflectors 56R and 56L.

Referring now to FIG. 1 again, chute 44 comprises bottom ball return panel 90 and identical ball retainers 92R and 92L. Bottom panel 90 is a one-piece, solid panel having a molded center groove. Retainer 92R includes top frame portion 94R, identical side frame portions 96R, 98R and bottom frame portion 100R. Frame portions 94R–100R, when connected, form a substantially rectangular frame-like structure with netting 82 laced, stitched or otherwise attached to each frame portion. Retainer 92L having frame portions 94L–100L and netting 82, is constructed in a similar manner as retainer 92R. Retainer 92R is hinged along the top right edge of bottom panel 90 with hinges 68. Retainer 92L is hinged along the top left edge of bottom panel 90 with hinges 68. The result being retainers 92R, 92L will fold from their upright ball return position to a flat position against bottom panel 90. Alternately, retainers 92R, 92L can be formed by one-piece solid panels without netting 82. Chute 44 provides a path for a basketball exiting collector 42, to return by gravity, towards the player standing at the free-throw line.

As shown in FIG. 2, prior to attachment of enclosure panel 88 as described earlier, a pair of drawer slides 102 are installed within cavity 54 for use by chute 44. Slide 102 is similar to slide 84 described earlier. The stationary members of each slide 102 are fixed by screws 106 between face panel 48 and rear panel 52. The slides are forward sloping with an angle of decline generally equal to that of return panel 50. The slidable members of slides 102 are permitted to extend diagonally through the front opening of face panel 48. The slidable members of slides 102 are then attached lenghtwise along opposite sides of bottom panel 90 with screws 106. The result being chute 44 is now glidingly linked or slidingly attached within cavity 54. Using handle 104, fixed by screws 106, chute 44 with retainers 92R, 92L folded flat, can be pulled telescopingly foward from a stored position within cavity 54, into its extended, releasably locked ball return position.

Figure 4:
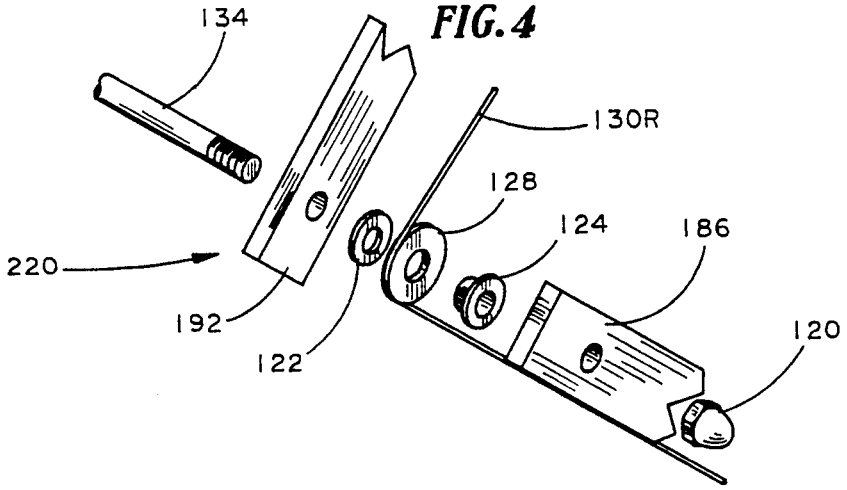
FIG. 4 is an exploded fragmentary view of a pivot connection used in the assembly of the lifting element as disclosed in FIG. 3.
Figure 3:
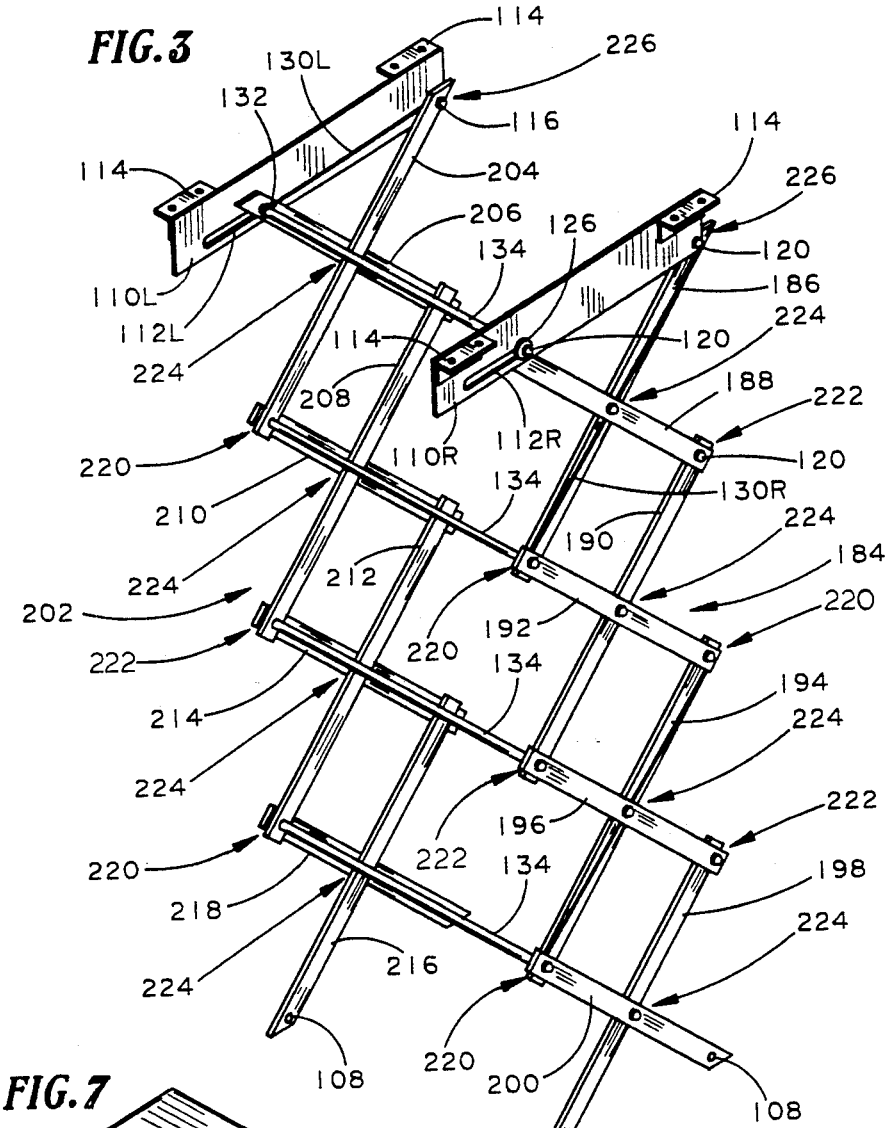
FIG. 3 is a perspective view of the lifting element of the device shown in FIG. 1.

As shown in FIGS. 1 and 7, collector 42 and chute 44 are mounted atop scissor lift 40. Referring now to FIG. 3, lift 40 includes right scissor arm assembly 184 and left scissor arm assembly 202. Assembly 184 comprises a plurality of scissor arms 186–200, pivotly connected at several common midpoints and several common endpoints. Pivot connections are 220, 222, 224 and 226. FIG. 4 shows a detailed view of pivot connection 220 comprising cap nut 120, spacer 122, bushing 124, pulley 128 and stabilizer bar 134. Referring to FIG. 3 again, pivot connection 222 includes cap nut 120, spacer 122, bushing 124 and bar 134. Pivot connection 224 comprises bolt 116, cap nut 120, spacer 122 and bushing 124. Pivot connection 226 includes bolt 116, cap nut 120, spacer 122, bushing 124 and pulley 128. In the absence of pulley 128, one or more spacers 122 will allow for adequate spacing of arms and clearance for the displacement of a pair of cables 130R, 130L, which will be fully described later.

Arms 186–200 are now pivotly connected and extensible linked, completing assembly 184. The upper ends of arms 186, 188 and the lower ends of arms 198, 200 remain unconnected, with each arm having hole 108 near its end. (upper holes 108 are hidden from view) Assembly 202 comprising arms 204–218, is pivotly connected and extensibly linked in a similar manner and is a mirror image of assembly 184. The upper ends of arms 204, 206 and the lower ends of arms 216, 218 remain unconnected, with each arm having hole 108 near its end. (upper holes 108 are hidden from view) Assemblies 184, 202 are now spaced vertically parallel and pivotly interconnected by pivot connections 220 and 222. Spacing of assemblies 184, 202 is defined by the length of stabilizer bars 134. Assemblies 184, 202 are now pivotly interconnected in such a way as to permit tandem vertically extensible movement when one set of the ends are pushed together. Conversely, tandem collapsable movement occurs when the ends are urged apart. Scissor assembly cover 228 as shown in FIGS. I and 7, is made of a lightweight, flexible material and provides a protective barrier against possible injuries when operating assemblies 184, 202. Cover 228 will eventually be fixed to enclosure panel 88, covering mounting plates 110R, 110L and also fixed to the top portions of floor supports 154R, 154L. Mounting plates and floor supports are described in succeeding paragraphs.

A pair of mounting plates 110R and 110L are also shown in FIG. 3. Plates 110R, 110L each having a set of brackets 114 attached, are pivotly connected to the upper unconnected ends of arms 186, 188, 204 and 206 respectively. Ends of arms 186 and 204 are pivotly fixed through holes 108 by pivot connection 226 near the rear of brackets 110R, 110L respectively. Slots 112R and 112L are provided in plates 110R, 110L for accepting rollers 126. Ends of arms 188, 206 are slidingly interconnected with rollers 126 by bar 134 through holes 108, with bar 134 terminating at each end with cap nut 120. This linkage permits tandem forward and reciprocating sliding motion of rollers 126 within slots 112R, 112L when urged to do so. Cables and associated cable drive responsible for initiating movement of rollers will be fully described later. Brackets 114 are now utilized to fix plates 110R, 110L to the underside portions of enclosure panel 88.

Figure 5:
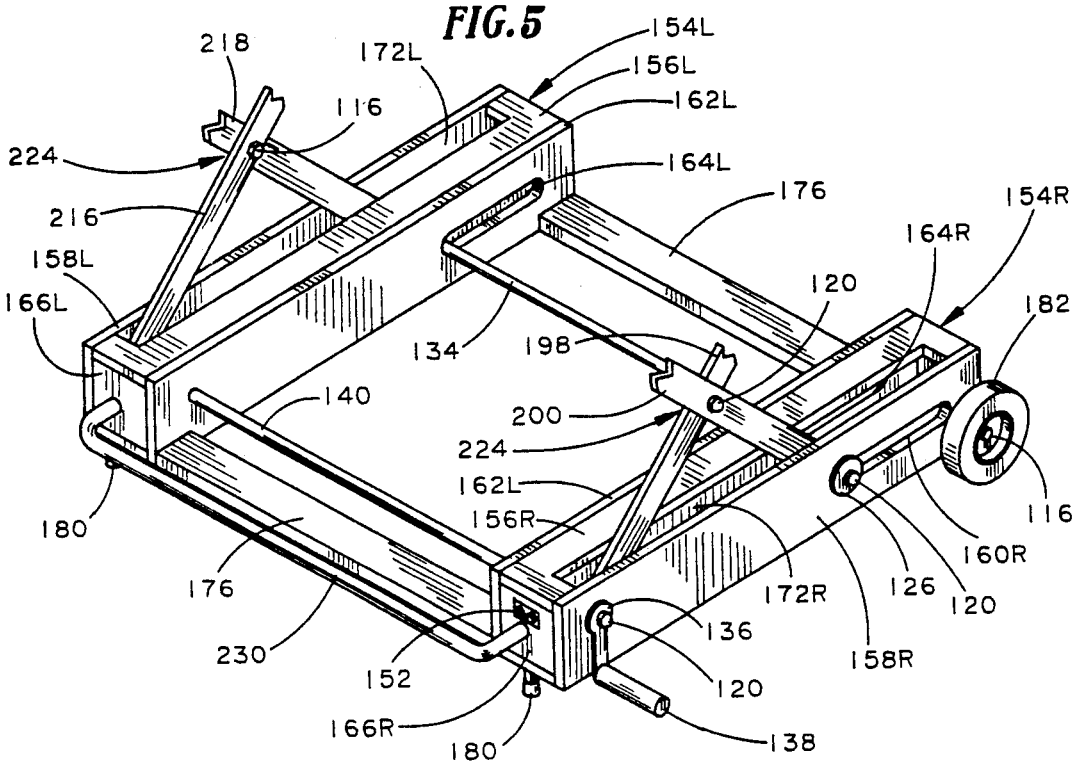
FIG. 5 is a perspective view of the floor engaging elements of the device shown in FIG. 1, with associated fragments of the lifting element.
Figure 6:
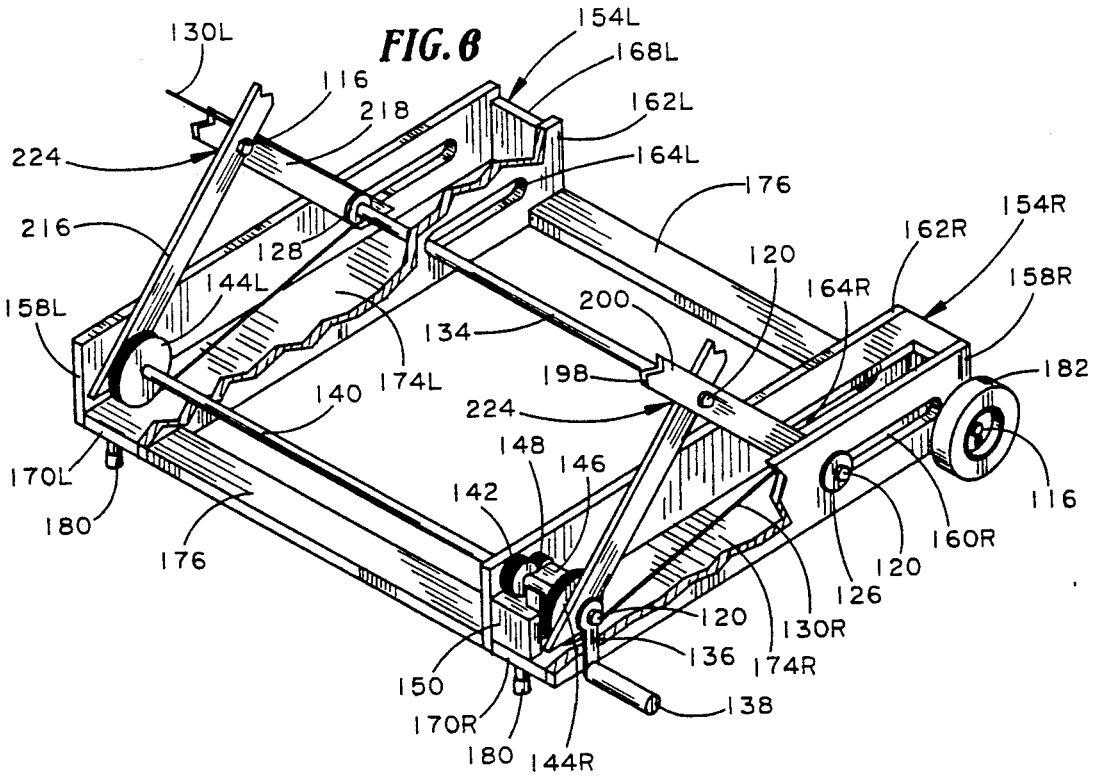
FIG. 6 is a fragmental view of the floor engaging elements showing details of the cable drive element of the device as first disclosed in FIG. 1.

As shown in FIGS. 5 and 6, right and left floor supports 154R and 154L provide a floor engaging base or foundation for assemblies 184, 202. Supports 154R, 154L also provide housing for cable drive system. Support 154R includes top panel 156R, side panel 158R having slot 160R, side panel 162R having slot 164R, front panel 166R, back panel 168R and bottom panel 170R. When connected, panels 156R–170R form a substantially rectangular enclosure having top opening 172R and creating cavity 174R. Support 154L is assembled in a similar manner, resulting in opening 174L and cavity 174L. Support 154L includes top panel 156L, side panel 158L having slot 160L, side panel 162L having slot 164L, front panel 166L, rear panel 168L and bottom panel 170L. Slots 160R, 160L accept rollers 126, whereas slots 164R, 164L provide openings for bar 134 to extend horizontally through. Openings 172R, 172L permit the lower unconnected ends of assemblies 184, 202 to pass through the tops of supports 154R, 154L and into cavities 174R, 174L. A pair of identical braces 176 allow for parallel spacing of supports 154R, 154L and also provide structural stability. Handle 230 is fixed to the front of each support and wheels 182 are attached by bolts 116 to the side rear of each support for ease of portability. The front end of supports 154R, 154L are spaced on a plane parallel to the playing surface by leg members 180.

In FIG. 6, the lower unconnected ends of arms 198, 216 are pivotly fixed through holes 108 near the front of supports 154R, 154L by crank shaft 140, which terminates at each end with cap nut 120. The unconnected ends of arms 200, 218 are slidingly interconnected within slots 160R, 160L. Arms 200, 218 are attached by bar 134 extending through holes 108 and rollers 126, with bar 134 terminating at each end with cap nut 120. The lower ends of assemblies 184, 202 are now pivotly fixed, slidingly linked and interconnected within cavities 174R, 174L. The assembly of lift 40 is now complete.

In order to manipulate vertical extension of lift 40, a pair of cables 130R, 130L are installed on opposed sides. As shown in FIG. 3, cable 130L is attached at the upper end of lift 40 by eye connector 132 journaled onto the left end of bar 134. Cable 130L is reeved around pulley 128 (hidden from view) at pivot connection 226 and starts on a downward path along arm 204. The remaining portion of cable 130L is hidden from view, but continues downward along arms 208, 212 and 218 and is reeved around each pulley located at pivot connections 220. As shown in FIG. 6, the lower end of cable 130L is reeved around pulley 128 located on the lowest bar 134 and terminates when fixed to the center spool of take-up reel 144L, which is journaled onto and fixed to the left end of crankshaft 140.

Referring to FIG. 3 again, cable 130R is attached at the upper end of lift 40 on the right end of bar 134 by eye connector 132. Cable 13OR follows a downward path along arms 186, 192, 194 and 200 and reeved around each pulley 128 located at pivot connections 220. Cable continues around pulley 128 (not shown, but identical to left side) journaled onto the lowest bar 134 and terminates when fixed to center spool of take-up reel 144R which is journaled onto and fixed on the right end of crank shaft 140 in FIG. 6.

As shown further in FIG. 6, a motorized cable drive is employed for displacement of cables 130R, 130L and actuating lifting sequence of lift 40. An electric rotory shaft motor 150, having controls 152, is connected through a worm gear transmission 146. A transmission output gear 148 meshes with crankshaft gear 142. Transmission 146 also serves a braking function by permitting rotational movement of output gear 148 in only one direction at a time. For outdoor use or the unavailability of an electrical source, alternate manual operation of the device is permitted. Crank arm 136 having crank handle 138, is journaled onto one end of crankshaft 140 prior to its termination at cap nut 120. Controls 152 will allow transmission 146 to function when rotational movement is supplied by turning crank arm 136 by crank handle 138.

FIG. 7 shows the basketball freethrow return device 38 in its completely collapsed, folded and retracted storage position.

OPERATION

In its completely collapsed configuration, the basketball freethrow return device 38, is positioned and centered with respect to the basketball goal on the playing surface directly beneath the goal. The lower deflectors 56R, 56L are unfolded into their substantially upright, rigid positions. The upper deflectors 70R, 70L are pulled vertically upwards from the lower deflectors into their uppermost, releasably locked ball deflection position. The chute 44 is then pulled forward from cavity 54 into its extended, releasably locked position. The retainers 92R, 92L are unfolded into their substantially upright, rigid ball return positions. The ball collector 42 and chute 44 are now fully functional and ready to be raised to receive the rim 32 and netting 34. For mechanical operation of the scissor lift 40, the corresponding motor control 152 is activated to begin lift cycle. The motor 150 shaft provides rotational energy to the internal gears of the worm gear transmission 146. The worm gear transmission 146 provides counter clockwise rotation of output gear 148 which meshes with crankshaft gear 142. Crankshaft gear 142 rotates in a clockwise direction, thereby turning crankshaft 140 and take-up reels 144R, 144L in a clockwise direction. Cables 130R, 130L, reeved around and guided by a plurality of pulleys 128, will wind clockwise around the center spools of reels 144R, 144L respectively. This displacement of cables 130R, 130L will eventually force the slidingly linked sets of upper and lower arms of scissor lift 40 to move, urging rollers 126 to slide within their respective slots 112R, 112L and 160R, 160L, causing extension of scissor assemblies 184, 202 and resulting in vertical lift of lift 40. For manual operation of lift 40, crank arm 136 is turned in a clockwise direction using crank handle 138, thereby manipulating the lifting events as described above. The lift cycle is continued until the top horizontal edges of the upper retainers 70R, 70L extend substantially above the plane of the rim 32. The rim 32 is bounded on both sides by the upper deflectors 70R, 70L in conjunction with the lower deflectors 56R, 56L, in the rear by backboard 30 and underneath by the grooved ball return panel 50. The collector 42 has an open top and front.

When the player makes a successful free throw, the basketball will pass downwardly through rim 32 and netting 34 striking return panel 50. Return panel 50 channels the ball into chute 44 and gravity will carry the ball through the chute 44, where it will exit and bounce towards the player standing at the free-throw line. If the free throw shot is unsuccessful, the ball will either bounce off the rim 32 or backboard 30 and deflected into the collector 42 by upper deflectors 70R, 70L or lower deflectors 56R, 56L. The ball will exit collector 42 and chute 44 and bounce towards the player standing at the free-throw line. In the case of forwardly rebounding basketballs that manage to bypass collector 42, the ball may be deflected by retainers 92R, 92L into chute 44 or bounce directly onto bottom panel 90. On a few occasions, the rebounding trajectory of the ball will cause it to bound over deflectors 70R, 70L or chute 44 and the player will have to chase the ball.

SUMMARY, RAMIFICATIONS, AND SCOPE

Accordingly, the reader will see that the basketball freethrow return device of this invention will enable most basketball players, regardless of age or stature, the opportunity to engage in positive, effortless and efficient free throw practice sessions. The ball collector and chute are capable of capturing and returning a high percentage of attempted shots. Without the disruptive time and wasted energy spent rebounding the basketball, the player is able to concentrate on shooting technique and form, resulting in better free throw accuracy. In addition, the vertical planes formed by the deflectors can actually enhance accuracy by focusing the players aim on the goal. The versatility afforded by the selectively adjustable, vertically extensible and collapsable lift, permits the adaptability of the ball collector to any goal, regardless of playing height or mounting means. The retractable upper deflectors and chute, along with the foldable lower deflectors and retainers, allow for quick set-up and ease of use. The device is also lightweight and portable for ease of storage. Furthermore, the basketball freethrow return device has additional advantages in that it can be produced in a variety of colors using materials such as plastic or aluminum; it is relatively simple and safe to operate and it can be manufactured in a non-motorized version.

Although the description above contains many specificities, these should not be construed as limiting the scope of the invention, but merely providing illustrations of some of the presently preferred embodiments. For example, the deflector and retainer netting can be eliminated in favor of solid panels; the scissor lift can be replaced by some other type of vertically extensible lift means; the ball collector could be formed by a skeletal frame using flexible materials as deflective surfaces; mechanization of deflectors, retainers and chute, etc.

Thus the scope of the invention should be determined by the appended claims and their legal equivalents, rather than by the examples given.

I claim:

1. A portable basketball freethrow return device comprising:

a ball collector having an inclined ball return panel, means forming first and second sets of telescopingly interconnected pairs of upper and lower ball deflectors, with said lower deflectors pivotly mounted on opposite sides of said return panel;

a chute defined by a bottom panel and a pair of opposed ball retainers pivotly connected to said bottom panel, with said chute extensibly connected and depending forward from the front portion of said collector forming a path for permitting a rebounded basketball to exit said collector and return, by gravity, towards a player standing at the freethow line;

a lifting means attached to portions of the underside of said collector, with said means having an associated drive mechanism for actuating lift sequence of said means, whereby said collector including said chute, can be vertically raised to receive a basket in an operative shooting position, thereby permitting said upper deflectors to project upwards substantially above said basket;

a floor support attached to the lower portion of second said means, with said support engaging a playing surface and supporting said means perpendicular to said playing surface.

2. The device of claim 1 wherein said collector is substantially rectangular.

3. The device of claim 2 wherein said collector further includes a front face panel having a lengthwise opening and a rear panel fixed at right angles at opposite ends of said return panel, a pair of support panels fixed on opposed sides of said return panel, with said supports also fixed perpendicularly between said face panel and said rear panel, and a bottom enclosure panel fixed along the bottom edges of said face panel, said rear panel and said support panels, thereby forming a cavity having a front opening defined by said face panel.

4. The device of claim 3 wherein said lower deflectors are pivotly mounted to said support panels, thereby permitting said deflectors to fold from a substantially upright ball deflection position to a flat inoperable storage position above said return panel.

5. The device of claim 3 wherein said chute is extensibly connected within said cavity by a pair of slidingly disposed self-latching members fixed diagonally between said face panel and said rear panel with portions of same said slides also fixed along opposed sides of said chute, thereby permitting said chute to depend telescopingly forward from a stored position within said cavity, through said opening of said face panel , into a releasably locked, extended ball return position.

6. The device of claim of 1 wherein first said means includes a plurality of slidingly disposed members having a self-actuating latching system operating to permit the slides to be releasably locked in a fully extended position.

7. The device of claim 6 wherein said slides are vertically attached along each end of said upper deflectors with a portion of same said slides also fixed along corresponding end portions of said lower deflectors, with said slides thereby permitting said upper deflectors to be raised vertically and releasably locked into their uppermost ball deflection position and said slides operating conversely to allow said upper deflectors to be lowered into their inoperable storage position on a plane generally parallel to said lower deflectors.

8. The device of claim 1 wherein said lifting means includes a scissor lift having first and second parallel sets of pivotly connected pairs of scissor arms, with the upper end of said lift pivotly connected in spaced parallel planes underneath said collector with the lower end of said lift pivotly mounted in spaced parallel planes to said floor support.

9. The device of claim 8 wherein said lift further includes a pair of cables fixed at the upper and lower ends of said lift, said cables reeved around a plurality of pulleys and a cable drive operating to displace said cables to force apart said arms of said lift, thereby permitting vertical extension of said lift, whereby said collector including said chute, can be raised vertically into said operative position beneath said basket and said lift operating conversely to lower said collector, thereby collapsing into a storable position.

10. The device of claim 1 wherein said floor support has a pair of floor engaging wheels fixed rearwardly for ease of portability and a pair of leg members attached forwardly to space said support on a plane generally parallel to said playing surface.

11. A portable basketball freethrow return device comprising:

a ball collector including a ball return panel, lower ball deflectors pivotly mounted on opposed sides of said return panel, with said lower deflectors folding flat above said return panel in the inoperative position, said collector further including an upper ball deflector telescopingly connected to each said lower deflector, permitting said upper deflectors to extend on a vertical plane substantially above said lower deflectors into a releasably locked ball deflection position, said lower and upper deflectors, in conjunction and substantially upright, defining a rear opening and a top opening in said collector for receiving a basket in an operative shooting position, with said lower and upper deflectors also defining a discharge opening in the front portion of said collector for permitting the discharge of a basketball;

a chute telescopingly depending from the front portion of said collector, with said chute including a bottom panel having a set of opposed pivotly connected ball retainers, said retainers folding flat against said bottom panel in the inoperative position, with said retainers in a substantially upright position defining a rear opening in said chute for receiving a basketball passing through said discharge opening of said collector, and said retainers also defining a discharge opening in the front portion of said chute for discharge of said basketball;

a vertically extensible and collapsable lift means mounted to said collector, with said lift means having an adjustable means operating to elevate said collector including said chute into an operative shooting position and permitting said upper deflectors to project upwards substantially a above the basket to deflect rebounding balls into said collector;

a floor support fixed to the lower portion of said lift means, with a por-of said support engaging a playing surface.

12. A basketball return device as defined in claim 11 wherein said return panel is in an inclined position and having a center groove slightly wider than the diameter of a standard basketball, with said return panel also having a shock absorbing material fixed to the flat surface on each side of said groove to reduce bounce activity of said basketball when striking said return panel.

13. A basketball return device as defined in claim 11 wherein said chute is extensibly connected to said collector by telescopingly interconnected slide members attached longitudinally to each side of said chute, with a portion of the same said slides also fixed to the underside of said collector, with said slide members operating to permit said chute to extend forward from the underside of said collector into a releasably locked ball return position, with slide members operating conversely permitting said chute to be pushed backwards underneath said collector in its storable position.

14. A basketball return device as defined in claim 11 wherein said lift means includes a scissor lift having a plurality of pivotly connected pairs of scissor arms forming a first and second parallel set of said arms pivotly interconnected, with said lift further including said adjustment means having a pair of flexible cables, a plurality of pulleys and a cable drive assembly operating to displace said cables reeved around said pulleys to permit vertical extension of said lift whereby said collector including said chute can be raised to receive said basket in said operative shooting position.

15. A basketball return device as defined in claim 14 wherein the elevation of said lift is selectively adjustable permitting said collector to receive baskets fixed at the standard basketball playing height above the floor and baskets temporarily fixed at a lower, abnormal playing position above the floor.

* * * * *